US006517270B2

(12) United States Patent
Endo et al.

(10) Patent No.: US 6,517,270 B2
(45) Date of Patent: Feb. 11, 2003

(54) PRINTER WITH FRAME MEMBER FOR SUPPORTING COMPONENTS

(75) Inventors: Katsuyuki Endo, Nagano (JP); Toshiya Matsuse, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/785,538

(22) Filed: Feb. 20, 2001

(65) Prior Publication Data

US 2001/0026724 A1 Oct. 4, 2001

(30) Foreign Application Priority Data

| | | |
|---|---|---|
| Mar. 28, 2000 | (JP) | 2000-089580 |
| Apr. 14, 2000 | (JP) | 2000-114036 |
| Apr. 14, 2000 | (JP) | 2000-114040 |

(51) Int. Cl.[7] ..... B41J 29/02
(52) U.S. Cl. ..... 400/691; 400/693
(58) Field of Search ..... 400/691, 692, 400/693, 694; 347/108, 170, 222, 245, 152

(56) References Cited

FOREIGN PATENT DOCUMENTS

| | | |
|---|---|---|
| DE | 24 43 175 | 3/1976 |
| EP | 0 950 529 | 10/1999 |
| JP | 63-197682 | 8/1988 |
| JP | 4-20272 | 2/1992 |
| JP | 5-147331 | 6/1993 |
| JP | 8-190332 | 7/1996 |
| JP | 8-276637 | 10/1996 |
| JP | 10-200674 | 7/1998 |

*Primary Examiner*—Daniel J. Colilla
(74) *Attorney, Agent, or Firm*—Nixon & Vanderhye P.C.

(57) ABSTRACT

In order to fix case members in relation to a frame member, an elongated fitting plate is fitted with fitting portions of the frame member and fitting portions of the case members. There is provided a fitting plate cover that covers the fitting plate and that fits to the case members thereby to constitute a part of the external shape of the printer. The fitting plate cover includes a protrusion for restraining the movement of the fitting plate. First and second engagement members are provided to fix a main case member with the frame member. The first engagement member prevents open-ends of side walls of the main case member from separating from the frame member. The second engagement member, which is located closer to closed-ends of the side walls, prevents the main case member from moving in the direction opposite to its attaching direction.

18 Claims, 14 Drawing Sheets

PRINTER WITH FRAME MEMBER FOR SUPPORTING COMPONENTS

BACKGROUND OF THE INVENTION

The present invention relates to the structure of a casing for a printer, and particularly to the structure in which a case member constituting an external shape of the printer is fixed to a frame member for supporting component parts that function for printing.

A typical printer has a structure wherein the component parts such as a print head, a paper feeding roller, or the like, are supported by a frame member made of metal having high rigidity, This frame member is covered with a case member formed of elastic material such as plastic or the like.

The printer having such typical structure is assembled by fixing the case member to the frame member usually using several screws. Alternatively, it is assembled by engaging engagement members formed on the frame member with engagement members formed on the case member, and then fixing the case member to the frame member using several screws.

As described above, in a typical related art printer, tightening the several screws is necessary to fix the case member. However, attaching or detaching these screws, when the maintenance and check of the printer insides are performed, becomes troublesome. On the other hand, when the case structure has no screws, attachment and detachment of the case member is facilitated, but when the case member has been attached to the frame member, the unity of these members is not complete. As a result, noise is undesirably produced by contact between the frame member and the case member when the printer operates and, problematically, the case member is broken. Therefore, there is required a case structure of the printer wherein the attachment and detachment of the case member is facilitated and the unity of the case member in relation to the frame member is improved.

SUMMARY OF THE INVENTION

Accordingly, an object of the present invention is to provide a printer in which the unity of the case member in relation to the frame member, when the case member is attached to the frame member, is improved. Another object of the present invention is to facilitate the attachment and detachment of the case member with respect to the frame member.

In order to achieve the above and other objects, according to the present invention, there is provided a printer comprising;

- a frame member for supporting components of the printer, the frame member including a first frame-side fitting member.
- a first case member, which constitutes at least a part of an external shape of the printer and which covers a part of the frame member, the first case member including:
  - a first side wall forming a side face of the printer;
  - a second side wall having a first end thereof connected to the first side wall, and having a second end opposite to the first end, wherein the second end is a free end;
  - a third side wall, opposite to the second side wall, having a first end connected to the first side wall, and having a second end opposite to the third-side-wall first end, wherein the third-side-wall second end is a free end;

- a first case-side fitting member provided on the second side wall so as to be located on one side of the first frame-side fitting member when the first case member covers the frame member; and
  - a second case-side fitting member provided on the third side wall so as to be located the other side of the first frame-side fitting member when the first case member covers the frame member; and
- an elongated fitting plate, for fixing the first case member with the frame member by engaging with the first frame-side fitting member as well as with the-first and second case-side fitting members.

In this configuration, by inserting or pulling out the fitting plate, the attachment and detachment of the first case member in relation to the frame member can be readily performed.

Preferably, the printer further comprises a second case member, which constitutes another part of the external shape of the printer while covering another part of the frame member. The frame member includes:

- a first side wall forming a side face of the printer, wherein said second-case-member first side wall opposes to the first side wall of the first case member;
- a second side wall having a first end connected to the second-case-member first side wall, and having a second end opposite to the second-case-member-second-side-wall first end, wherein the second se-member-second-side-wall second end is a free end;
- a third side wall, opposite to the second-case-member second side wall, having a first end connected to the second-case-member first side wall, and having a second end opposite to the second-case-member-third-side-wall first end, wherein the second-case-member-third-side-wall second end is a free end;
- a third case-side fitting member provided on the second-case-member second side wall so as to be located on said one side of the first frame-side fitting member when the second case member covers the frame member; and
- a fourth case-side fitting member provided on the second-case-member third side wall so as to be located on said other side of the first frame-side fitting member when the second case member covers the frame member.

The fitting plate fixes the first and second case members with the frame member by engaging with the first frame-side fitting member as well as with the first, second, third and fourth case-side fitting members.

Preferably, the frame member includes a second frame-side fitting member, with which the fitting plate engages when the first case member is fixed with the frame member.

In this configuration, since the fitting plate fits to the two engagement portions provided in the frame member, the degree of tightness between the frame member and the first and second case members can be improved.

Preferably, the first side wall of the first case member is urged so as to abut against the opposing face of the frame member, when the fitting plate engages with the respective fitting members.

In this configuration, since it is possible to fix the relative position of the first case member in relation to the frame member, looseness of the case member in relation to the frame member can be eliminated.

Preferably, the first frame-side fitting member is a through hole, through which the fitting plate is inserted.

In this configuration, the fitting plate can be reliably fitted to the first frame-side fitting member.

Preferably, the through hole is provided with a guide portion for guiding the fitting plate therein.

By the guide portion, the fitting plate can be readily caused to pass through the through hole.

Preferably, the frame member is attached to the first case member by moving the frame member from the second ends toward the first ends of the first-case-member second and third side walls The printer further comprises:

a first engagement member, for preventing the second ends of the is second and third side walls of the first case member from separating, when the first case member covers the frame member;

a second engagement member, for preventing the first case member from being detached from the frame member in a reversed direction of the attaching direction, wherein the second engagement member is located closer to the first ends of the first-case-member second and third side walls than is the first engagement member; and a disengagement member, for releasing the engagement of the second engagement member, wherein the disengagement member is located closer to the first ends of the first-case-member second and third side walls than is the second engagement member.

In this configuration, when the first case member is attached to the frame member, the first and second engagement members are respectively in the fitting state, so that the open ends of the second and third side walls of the first case member are prevented from separating outwards. Additionally, simultaneously, the first case member is prevented from slipping out of the frame member in the direction opposite to the attaching direction of the first case member.

Preferably, the first engagement member includes a first engagement claw formed on the first case member, and a first engagement piece formed on the frame member, which is engaged with the first engagement claw. The second engagement member includes a second engagement claw formed on the first case member, and a second engagement piece formed on the frame member, which is engaged with the second engagement claw.

In this configuration, the engagement through use of the second engagement member an be made more reliable. Further, the engagement can be readily released.

Preferably, the printer further comprises a third engagement member, for preventing the first case member from being detached from the frame member in a direction orthogonal to the attaching direction, when the first case member covers the frame member.

Preferably, the third engagement member includes a guide member for guiding the first case member in the attaching direction with respect to the first case member Preferably, the disengagement member is provided as cutoff portions, respectively formed on the second and third side walls of the first case member, through which fingers may be inserted to press the second and third side walls outwardly.

Preferably, the first case member includes a fourth side wall that extends substantially orthogonally to the first side wall so as to connect third ends of the second and third side walls. The first and second engagement members are provided in a portion closer to fourth ends of the second and third side walls, which is opposed to the third ends thereof.

Preferably, the printer further comprises a cover member, which constitutes another part of the printer while engaging with at least one of the first and second case members and the frame member, the cover member including a protrusion for restricting movement of the elongated fitting plate by engagement therewith.

In this configuration, the movement of the elongated fitting plate is restrained by attaching a fitting plate cover for covering this fitting plate, whereby attachment of the frame member to the case members becomes firmer.

Preferably, the cover member includes a first cover-side fitting member that is fitted with at least one of the second case member and the frame member through use of the engaging motion of the fitting plate. The protrusion is formed in the vicinity of the first cover-side fitting member.

This configuration suppresses the reduction in the degree to which the protrusion restrains the fitting plate, even if manufacturing error and aged deterioration occur in these members.

Preferably, the fitting plate includes a hole, with which the protrusion is engaged when the cover member is engaged with at least one of the second case member and the frame member.

Preferably, the fitting plate includes: a first portion extending in a first direction so as to include one end thereof; a second portion extending in the first direction so as to include the other end of thereof, and a third portion extending perpendicular to the first direction so as to connect the first and second portions. The first portion is engaged with the first frame-side fitting member as well as with the second, third and fourth case-side fitting members. The second portion is engaged with the second frame-side fitting member and the first case-side fitting member.

Preferably the cover member has a shape so as to extend along at least a part of the elongated fitting plate. The first cover-side fitting member is formed on one end portion of the cover member. The cover member includes a second cover-side member formed on the other end portion thereof, which is engaged with at least one of the first cover member and the frame member.

According to the configurations described above, the unity of the case member in relation to the frame member can be further improved by the foregoing fitting structure and also the attachment and detachment of the case member can be performed very readily.

Furthermore, tightening of the case member in relation to the frame member can be performed using a single elongated fitting plate without using a screw. Therefore, the attachment and detachment of the case member is performed very readily and the fixing metal fitting is prevented from slipping by the fitting plate cover for covering the fixing plate, so that though the above attachment and detachment is facilitated, the tightening can be completely performed.

BRIEF DESCRIPTION OF THE DRAWINGS

The above and other objects and advantages of the present invention will become more apparent by describing in detail a preferred exemplary embodiment thereof with reference to the accompanying drawings, wherein like reference numerals designate like or corresponding parts throughout the several views, and wherein.

DETAILED DESCRIPTION OF THE PREFERRED EMBODIMENTS

Figure 1:
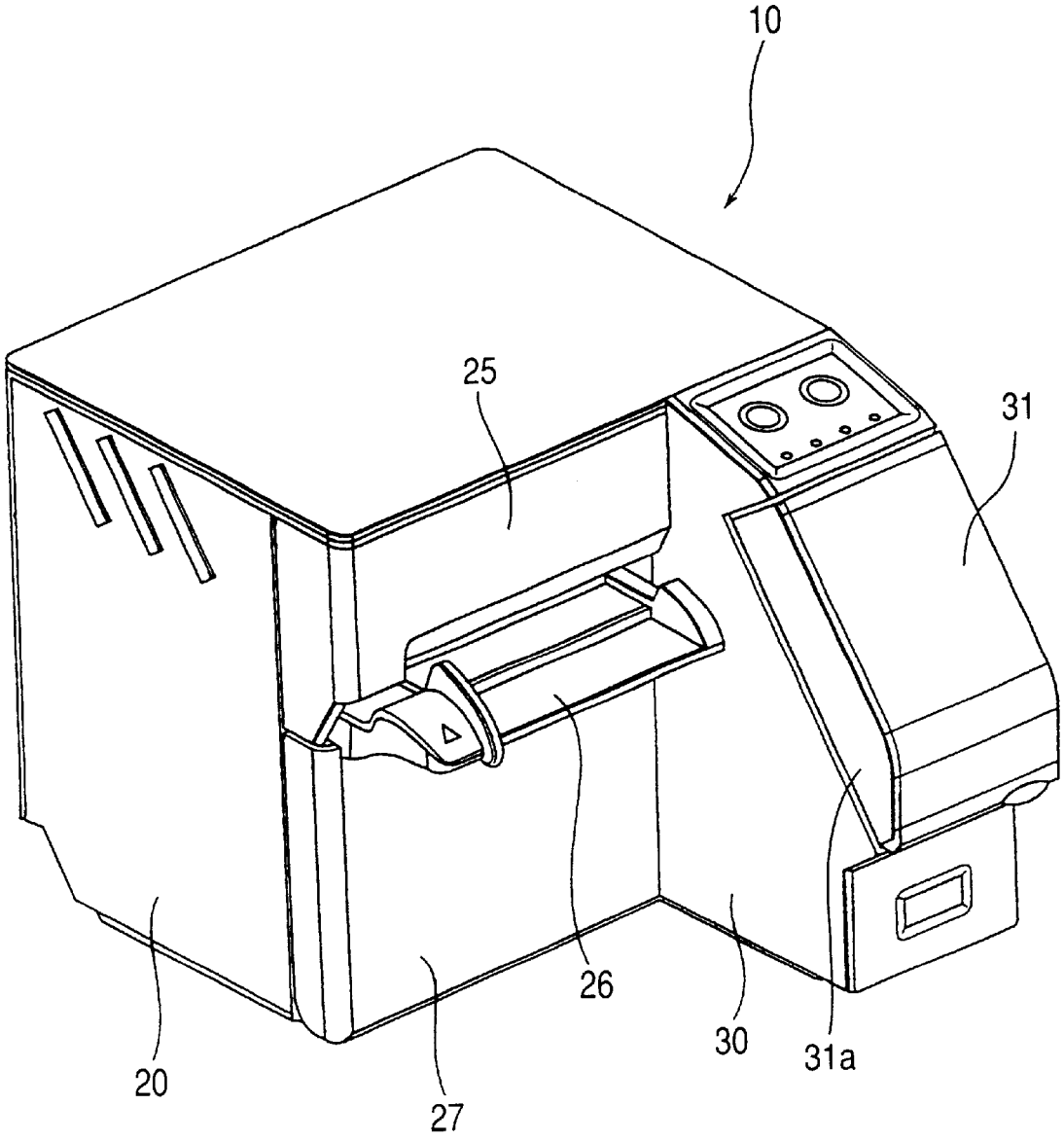
FIG. 1 is an external perspective view of a printer according to one embodiment of the invention.
Figure 2:
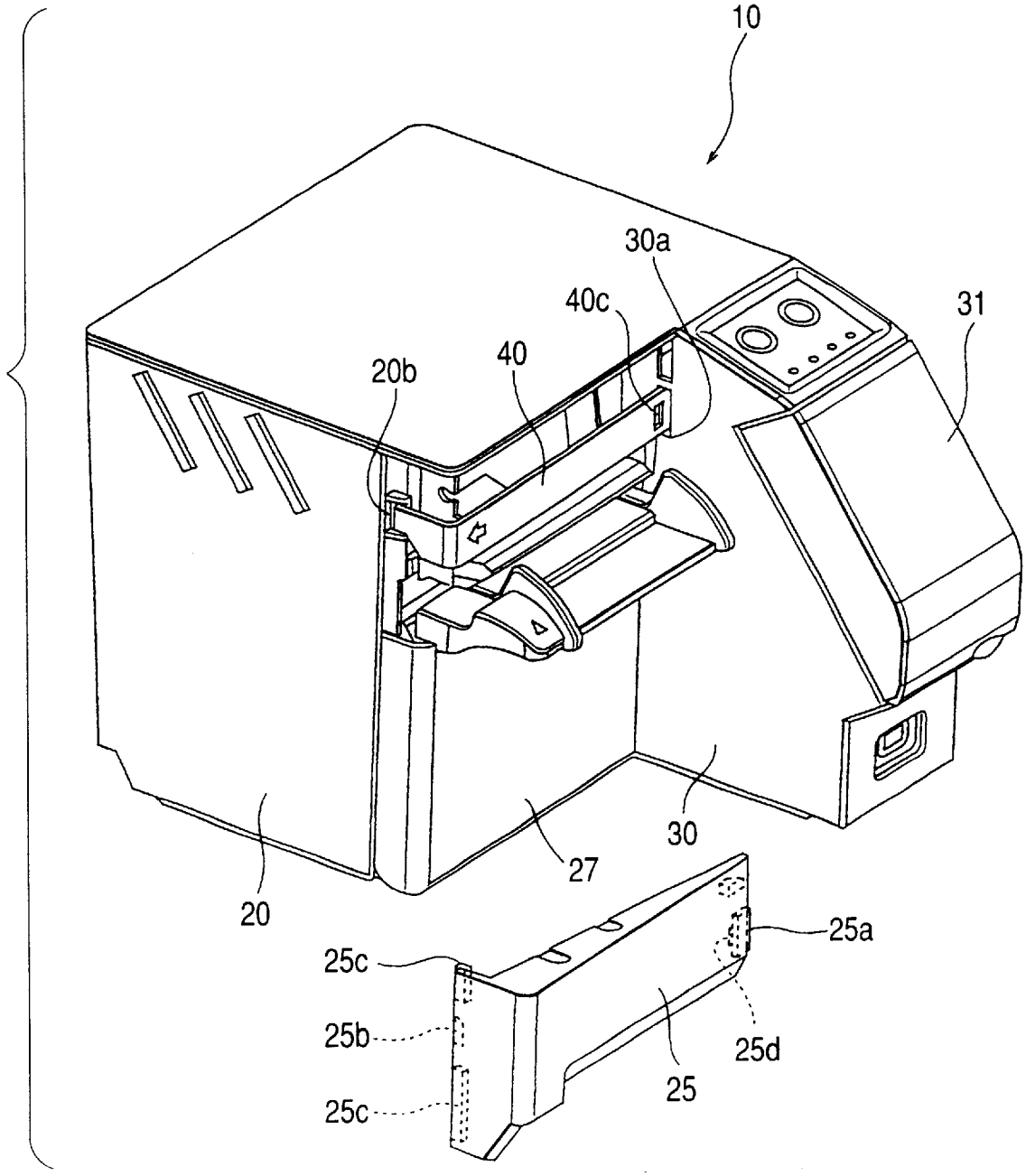
FIG. 2 is an external perspective view of the printer wherein a fitting plate cover is detached.
Figure 3:
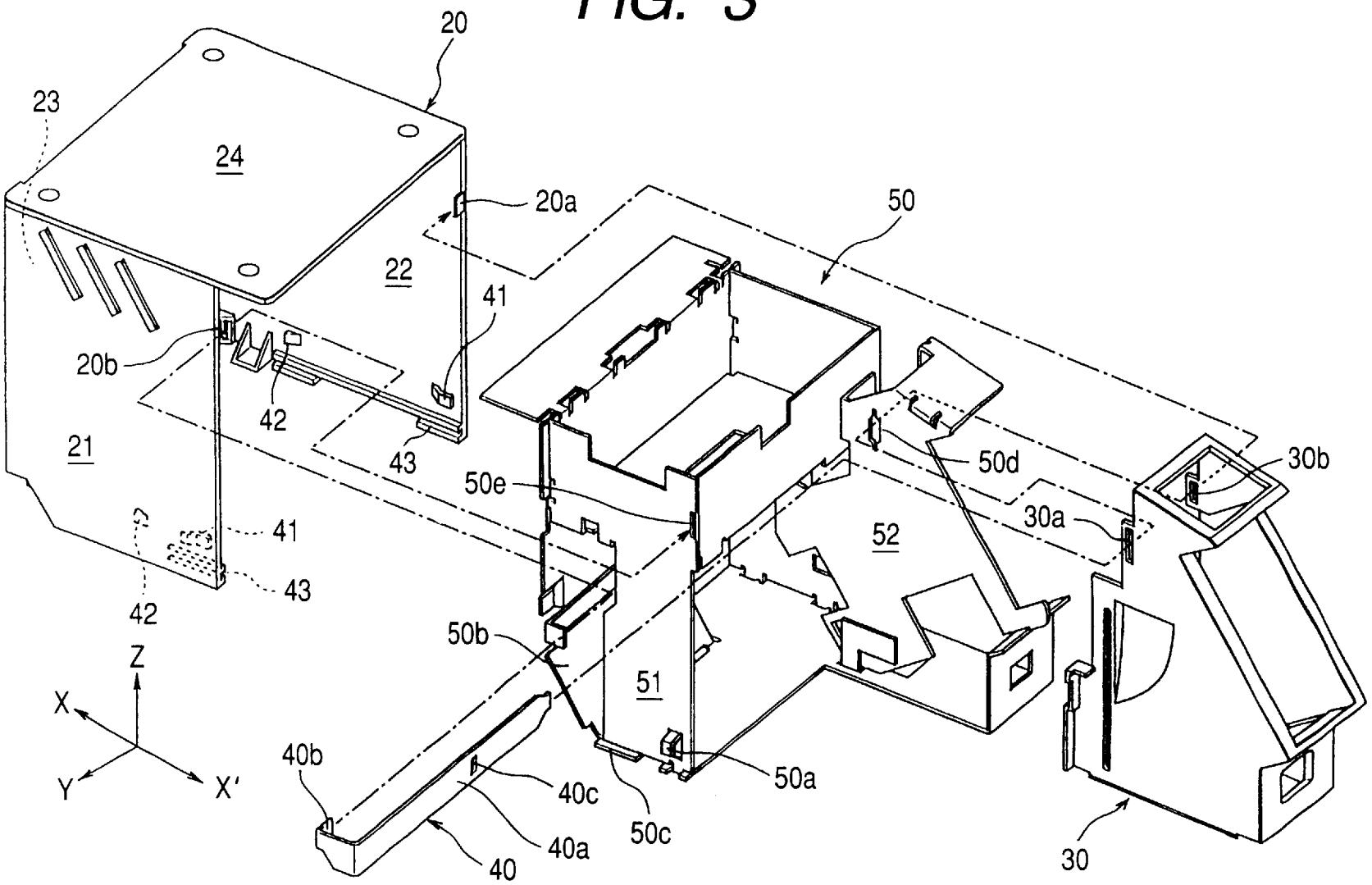
FIG. 3 is an exploded perspective view showing the casing structure of the printer.

One embodiment of the invention will be described below with reference to the accompanying drawings. A printer 10 shown in FIG. 1 performs, for example, ink-jet-type printing, in which components for printing are mounted inside of a frame member (50 as shown in FIG. 3). The frame member is then covered with a main or first case member 20, and with a front or second case member 30, thereby to constitute the printer. These main case member 20 and front case member 30 are formed of elastic material such as plastic. Further, the main case member 20 and the front case member 30 are fixed to the frame member by a fitting plate 40, shown in FIG. 2, whereby they are integrally formed. To the upper portion on the front face of the printer 10, a fitting plate cover 25 is attached so as to cover this fitting plate 40. Accordingly, regarding the casing structure of the printer 10, its external shape is constituted by covering the frame member—which is equipped with the internal printer components—with the main case member 20 and the front case member 30, fixing these case members with the fitting plate 40, and further attaching the fitting plate cover 25 onto the fitting plate 40. Further, the lower portion of a paper discharging face 26 is covered with a front cover 27 formed integrally with a rolled sheet housing door (not shown).

Within the main case member 20, a printing mechanism (not shown) such as a print head, a paper feeding roller, or the like, is placed on the frame member. Further, a housing space in which a rolled sheet can be housed is formed. The rolled sheet housed in the housing space is pulled out from the front side of the printer 10, and is discharged from the paper discharging face 26 after printing. Within the front case member 30, an ink cartridge housing space is formed on the frame member, and a door cover 31 is provided on the front face of the front case member 30, which door cover 31 is used when an ink cartridge is loaded. The door cover 31 is supported rotatably in relation to the front case member 30 by projections (not shown) provided at the upper and lower end portions of its left end side 31*a*, whereby the projections are used as a support shaft. The user opens this door cover 31 to load or exchange the ink cartridge.

FIG. 3 is an exploded perspective view showing the casing structure of the printer 10. Referring to that figure, the fixing structure of the case member to the frame member will be described. In the figure, the internal components of the printer that are mounted onto the frame member 50 are omitted.

The frame member 50 is formed of iron or other metal material having rigidity. Also, the frame member 50 is schematically composed of two component parts, that is, a main frame part 51 and a front frame part 52. The main frame part 51 is equipped with the main internal components of the printer, such as an ink-jet-type printing mechanism, a sheet transporting mechanism, a rolled sheet housing, and the like. The main frame part 51 is covered with the main case member 20. The front frame part 52 is equipped with an ink cartridge storage section, an ink supplying section, and the like. The front frame part 52 is covered with the front case member 30.

Firstly, the fixing structure of the main case member 20, and front case member 30, both in relation to the frame member 50 at their upper portions will be described. Regarding the fixing of the upper portion of each case member, a long plate-shaped fitting plate 40 is used. Schematically speaking fitting holes and fitting pieces respectively formed in the case members 20, 30 and the frame member 50 are arranged so as to fit their positions to one another when the case members are mounted to the frame member. The fitting plate 40 is inserted through the fitting holes and fitting pieces to perform mutual fixation of the case members 20, 30 and the frame member 50.

The fitting plate 40 is a long plate-shaped member that is formed of metal material, such as iron or the like, having rigidity. A part of the fitting plate 40 longitudinally extends straight and forms a first engagement portion 40*a* whereas one end portion of the plate is bent back to form a second engagement portion 40*b*. Since a leading end of the first engagement portion 40*a* is tapered, the fitting plate 40 is readily inserted into a fitting hole 50*d* of the frame member 50 (as described later). As shown in FIGS. 2 and 3, in the first engagement portion 40*a*, there is formed a fitting hole 40*c* to be fitted with a protrusion 25*d* of the fitting plate cover 25 (as described later), whereby the fitting plate 40 is prevented from slipping. This particular constitution and action will be described later.

To engage with the first engagement portion 40*a* of the fitting plate 40, a fitting hole 50*d* is formed in the frame member 50, a fitting piece 20*a* is formed in the main case member 20, and two fitting holes 30*a*, 30*b* are formed in the front case member 30.

When the main case member 20 and the front case member 30 are mounted to the frame member 50, the fitting holes 30*a*, 30*b* of the front case member 30 are located on both sides of the fitting hole 50*d* of the frame member 50, and the fitting piece 20*a* of the main case member 20 is located on an outer side of the fitting hole 30*b*. The positions of these fitting holes and fitting piece roughly correspond to one another in the attaching state of each case member.

Thus, the fixing together of these members is performed by inserting the first engagement portion 40*a* of the fitting plate 40 therethrough. Namely, the leading end of the first engagement portion 40*a* of the fitting plate 40 is inserted to the fitting holes 30*a*, 50*d*, and 30*b* in that order, as shown by a phantom line, and lastly it is fitted to the fitting piece 20*a* of the main case member 20.

When the front case member 30 is mounted to the frame member 50, its fitting holes 30*a* and 30*b* are located off the center position of the fitting hole 50*d* of the frame member 50. The fitting holes 30*a* and 30*b* are off-center to the front side due to the contact of the front portion of the frame member 50 and the front portion of the front case member 30. As shown in FIG. 3, the central region of the fitting hole 50*d* is formed widely, so that even if the fitting holes 30*a*, 30*b* are located off the center position of the fitting hole 50*d*, as mentioned before, the tapered end of the first engagement portion 40*a* of the fitting plate 40 can be inserted into the fitting holes 30*a*, 50*d*, 30*b*.

While the fitting plate 40 is being inserted into these fitting holes and its leading end portion is passing through the fitting hole 50*d* of the frame member, the first engagement portion 40*a* is guided to the narrowed portion of the fitting hole 50*d* by slants formed at the leading end portion of the fitting plate 40 and in the fitting hole 50*d*, so that the front case member 30 is fixed firmly to the frame member 50.

To engage with the second engagement portion 40*b* of the fitting plate 40, a fitting hole 50*e* is formed in the frame member 50, and a fitting hole 20*b* is formed at the end portion of one side wall 21 in the main case member 20.

When the main case member 20 is mounted to the frame member 50, the fitting hole 20*b* is located outside the fitting hole 50*e*. The positions of these fitting holes roughly correspond to each other in the attaching state of the main case member 20, and the second engagement portion 40*b* of the fitting plate 40 is inserted into these holes thereby fixing the main case 20 and frame 50 members. Namely, the second engagement portion 40*b* of the fitting plate 40 is inserted into the fitting hole 20*b* and the fitting hole 50*e* in that order as shown by a phantom line.

When the main case member 20 is mounted to the frame member 50, the fitting hole 20*b* and the fitting piece 20*a* are respectively located off the center position of the fitting hole 50*e* and the fitting hole 50*d* of the frame member 50. The fitting hole 20*b* and fitting piece 20*a* are off-center to the back side due to the contact between the back face of the frame member 50 and a projection 20*c* (refer to FIG. 7) formed at the inner back face of the main case member 20. When the first and second engagement portions 40*a* and 40*b* are inserted into these fitting holes 50*d*, 50*e*, as described above, their positions are fitted to one another. At this time, both side walls 21 and 22 of the main case member 20 are pulled toward the frame member 50. That is, at this time, the central region of the back face of the frame member 50 is strongly pressed against the projection 20*c* of the main case member 20, whereby these members are firmly fixed.

Figure 4:
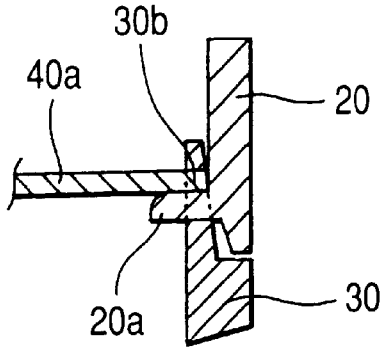
FIG. 4 is an enlarged sectional view showing an engagement portion at the leading end of a first engagement portion of a fitting plate.
Figure 5:
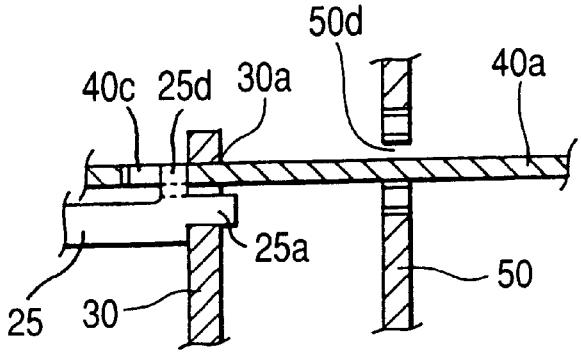
FIG. 5 is an enlarged sectional view showing an engagement portion in the center of the first engagement portion of the fitting plate.
Figure 6:
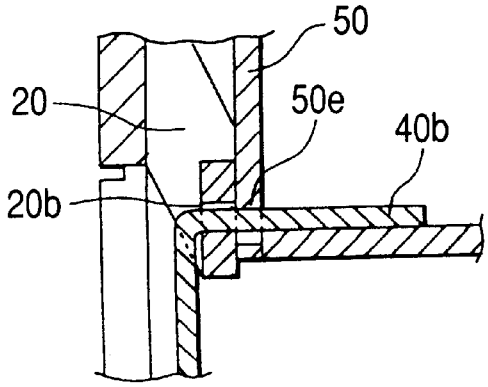
FIG. 6 is an enlarged sectional view showing an engagement portion at the leading end of a second engagement portion of the fitting plate.

FIGS. 4 to 6 are enlarged sectional views of each engagement portion of the fitting plate 40. As shown in FIG. 4, the leading end portion of the first engagement portion 40*a* fits to the fitting piece 20*a* of the main case member 20 and fits into the fitting hole 30*b* of the front case member 30. As shown in FIG. 5, the center portion of the first engagement portion 40*a* fits into the fitting hole 50*d* of the frame member 50 and also fits into the fitting hole 30*a* of the front case member 30. As shown in FIG. 6, the leading end portion of the second engagement portion 40*b* fits into the fitting hole 50*e* of the frame member 50 and fits into the fitting hole 20*b* of the main case member 20. The fitting holes 50*d*, 50*e* constitute frame-side fitting members, and the fitting piece 20*a*, the fitting hole 20*b*, the fitting hole 30*a*, and the fitting hole 30*b* constitute case-side fitting members.

Figure 7:
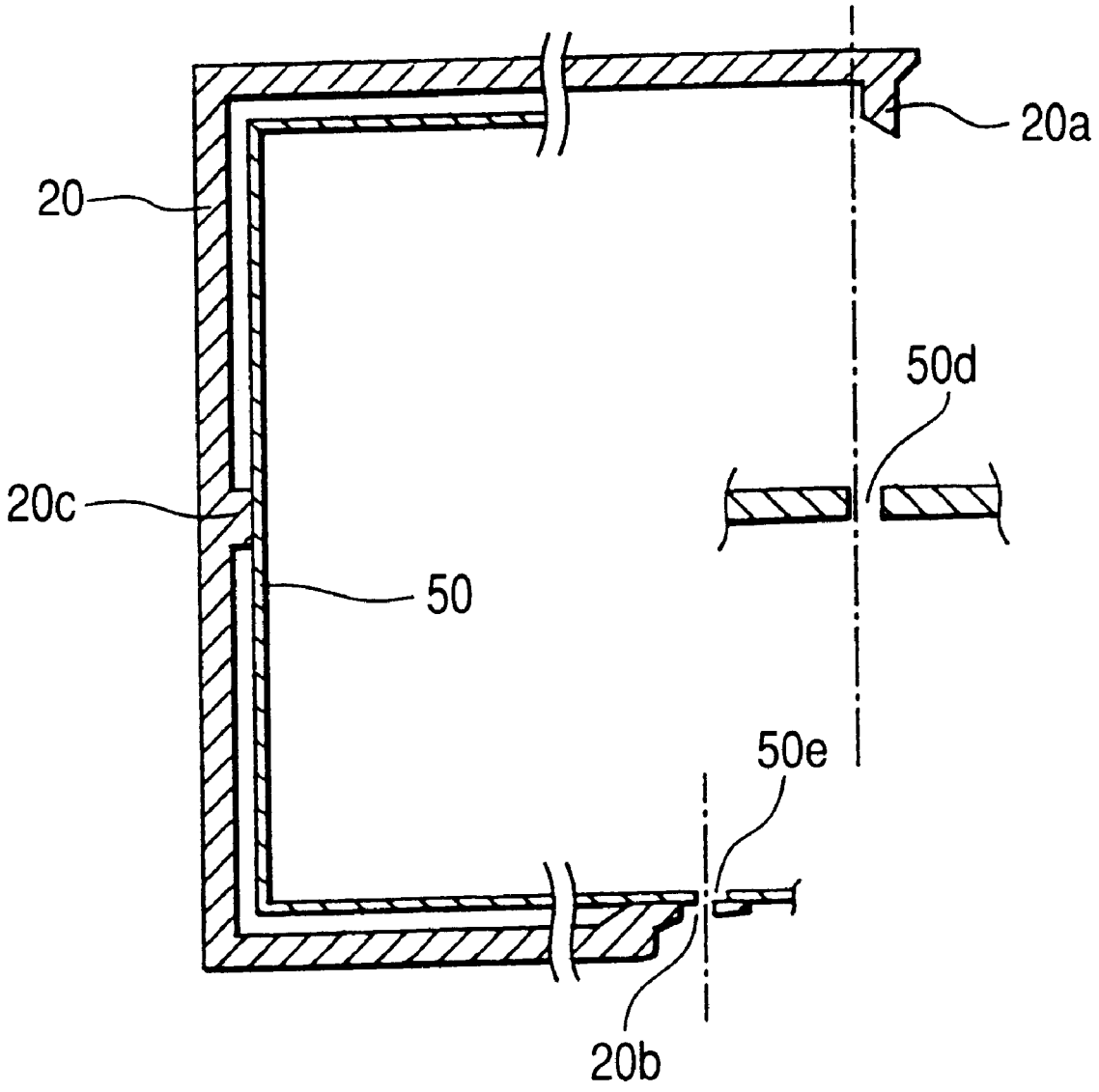
FIG. 7 is a sectional plan view showing abutment of a main case member against a frame member.

FIG. 7 is a plan view showing the relative position of the main case member 20 in relation to the frame member 50, wherein this figure is an enlarged sectional view of the main case member 20 and frame member 50. As shown in the figure, nearly in the center of the inner face of the back wall of the main case member 20, the projection 20*c* is integrally provided. Also, as shown in the figure, when this projection 20*c* is brought into contact with the back face of the frame member 50, before the fitting plate 40 is inserted, the fitting piece 20*a* of the main case member 20, and the fitting hole 50*d* of the frame member 50, are slightly shifted in the horizontal direction. Further, the fitting hole 20*b* and the fitting hole 50*e* are slightly shifted in the horizontal direction. In this state, the fitting plate 40 is inserted into these holes and engaged with the fitting piece 20*a*, whereby both ends of the main case member 20 are pulled to the right in the figure, and the back wall in which the projection 20*c* is formed is elastically deformed so as to be slightly curved. Hereby, the projection 20*c* is pressed against the back face of the frame member 50, and looseness of the main case member 20 in relation to the frame member 50 is eliminated. Further, though not illustrated, a similar structure is adopted in the front case member 30 in relation to the frame member 50.

Figure 8:
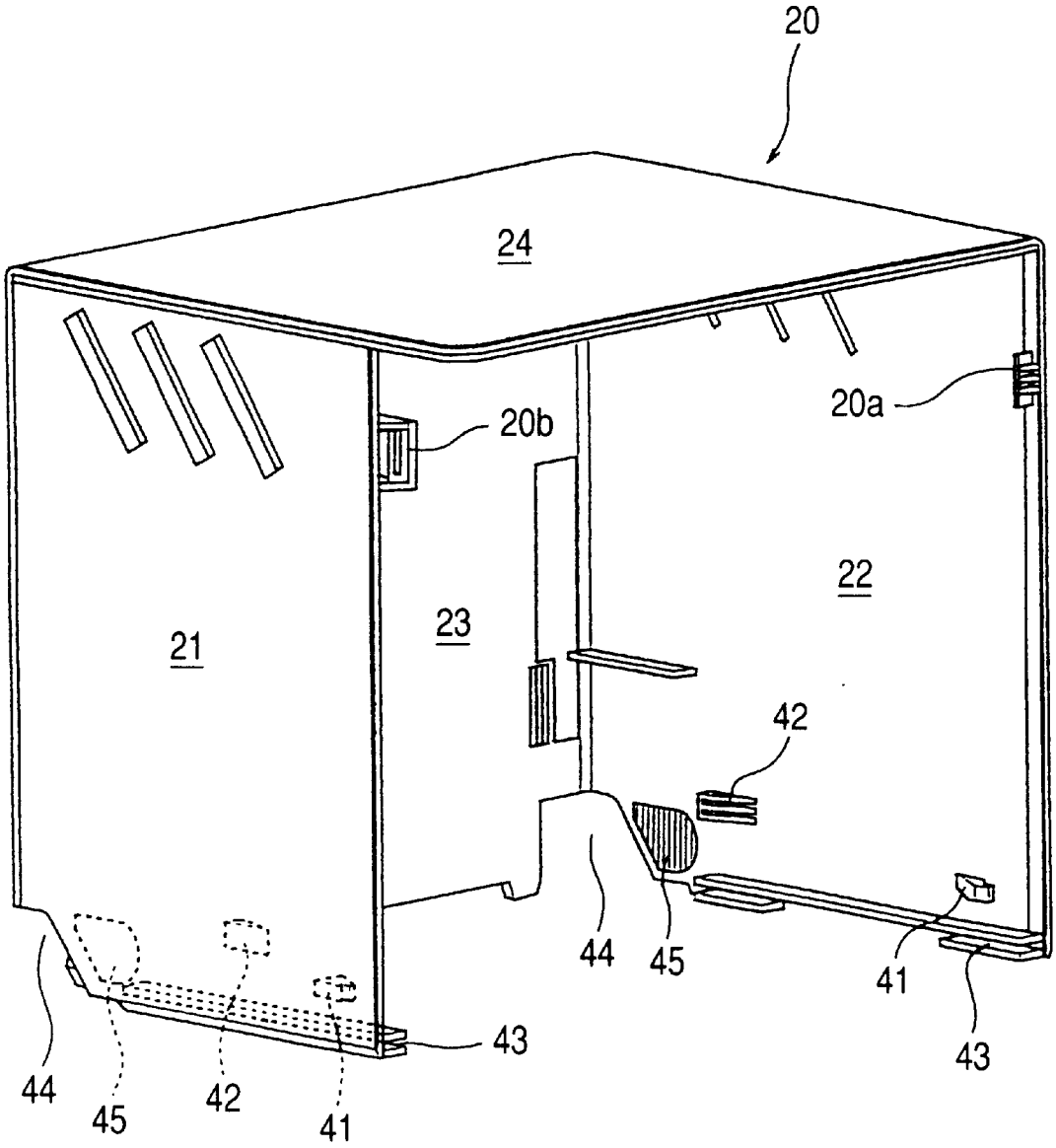
FIG. 8 is a perspective view of the main case member.

Next, the structure by which the lower portion of the main case member 20 fits to the frame member 50 will be described in detail. Referring to FIGS. 8 to 13 in addition to FIG. 3, this will be described below .As shown in FIGS. 3 and 8, the main case member 20 is formed substantially in the shape of a square bracket, as viewed in a plane manner. The case member 20 is composed of a pair of side walls 21, 22, a back wall 23, and a top wall 24. The back wall 23 couples one end of each of the side walls 21, 22, whereas the top wall 24 connects the upper portions of these walls 21, 22, 23. The front side of the main case member 20, as clearly seen in the figure, is opened. The main case member 20 is slid from its open end toward the frame member 50 (in the X' direction in FIG. 3), and thusly the frame member 50 is covered with the main case member 20.

The fitting of the main case member 20 in relation to the frame member 50 will now be discussed. At the lower portions of the inner wall faces of the both side walls 21, 22, fitting claws 41, 42 and a fitting groove 43 are formed. When the main case member 20 is mounted to the frame 50, the fitting claws 41,42 and fitting groove 43 fit respectively to three fitting pieces 50*a*, 50*b* and 50*c* formed on the side face of the main frame part 51 thereby to restrain the movement of the main case member 20 in relation to the frame member 50.

Figure 9A:
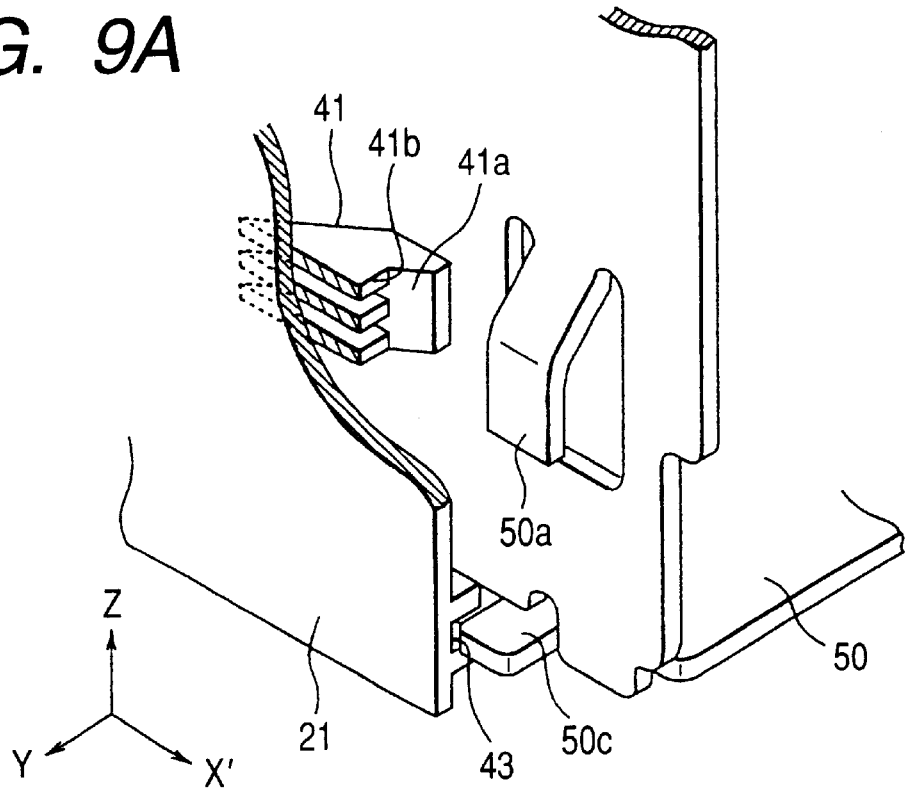
FIG. 9A is an enlarged perspective view of a fitting structure at a lower portion of the printer, showing a state before fitting.
Figure 9B:
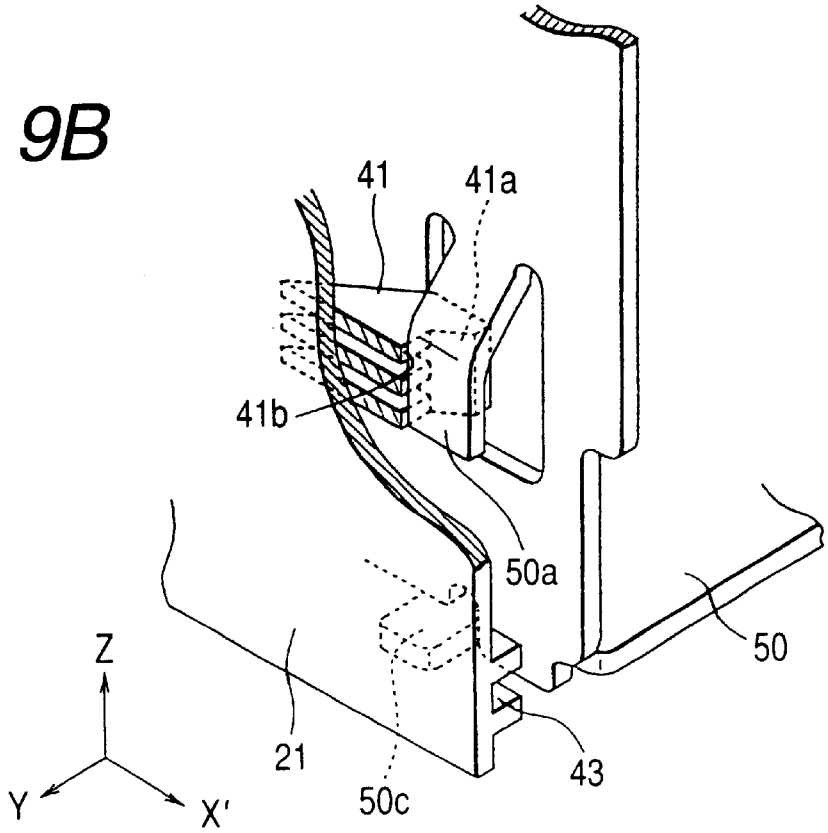
FIG. 9B is an enlarged perspective view of a fitting structure at a lower portion of the printer, showing a fitting state.

The fitting claws 41, on the main case member 20, are formed near the open ends of the both side walls 21, 22 (near the front end of the case member). Each fitting claw 41, as shown clearly in FIGS. 9A and 9B, faces to the open end of the main case member 20, and has a leading end portion 41*a* spaced from the side wall. As a member corresponding to this leading end portion 41*a*, a fitting piece 50*a*—formed by cutting and raising the side wall—provided at a corresponding position on the side face of the main frame part 51. As shown in FIGS. 9A and 9B, by sliding the main case member 20 forward in relation to the frame member 50, the leading end portion 41*a* of the fitting claw 41 is guided to the inside of the fitting piece 50*a*. The sliding of the main case member 20 stops at the position where a face 41*b*, of a base end portion of the fitting claw 41, abuts the side face of the fitting piece 50*a* (FIG. 9B). In this state, the X'-directional movement of the main case member 20 is restrained, and the Y-directional movement thereof is also restrained. By restraining the Y-directional movement, neither one of the side walls 21, 22 can be expanded outward even if it receives external forces, so that the unity of the main case member 20 in relation to the frame member 50 is improved.

The fitting grooves 43, on the main case member 20, are formed along lower sides of both side walls 21, 22. The open sides of the fitting grooves 43 face to the side faces of the frame member 50, and fitting pieces 50*c*—formed along the lower sides of the main frame part 51 are fitted to these fitting grooves 43. The fitting grooves 43 serve as a guide when the main case member 20 is slid from the back side of the frame member 50 toward the front side of the frame member 50. Also, in the mounting state as shown in FIG. 9B, the fitting grooves 43 restrain the main case member 20 from moving up and down (in the Z direction in the figure). It is desirable to refer to also FIG. 13 regarding the function of the fitting grooves 43.

Figure 10:
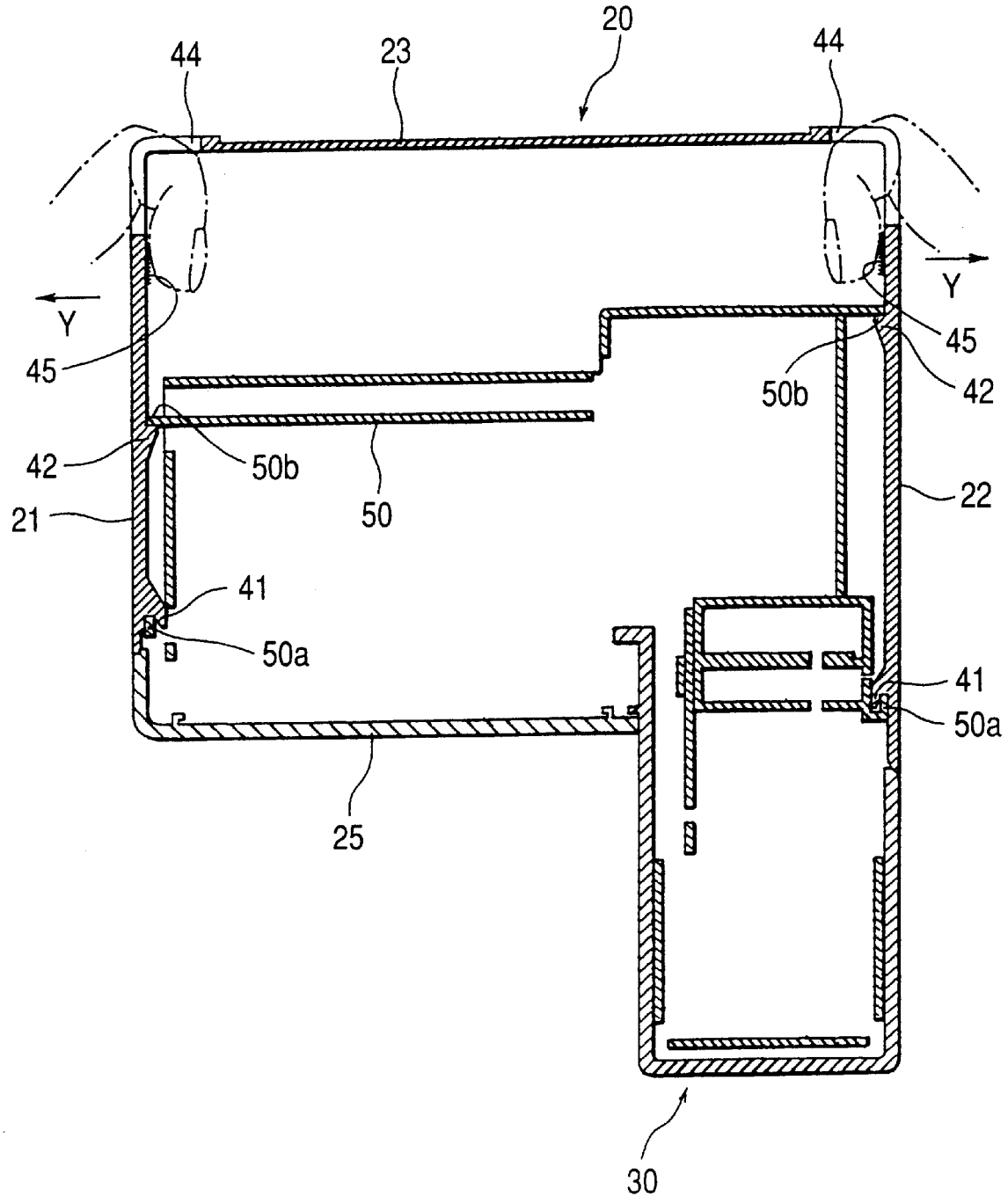
FIG. 10 is a sectional plan view showing the fitting relation between the main case member and the frame member.

Next, the fitting claws 42, on the main case member 20, are arranged in the side walls 21, 22, nearer the back wall 23 than are arranged the fitting claws 41. Since the positions of the corresponding fitting pieces 50*b* on the frame member are different from each other, the fitting claw 42 on one side wall 21 is located relatively in front, whereas the fitting claw 42 on the other side wall 22 is located relatively at the back of the main case member 20. In FIG. 10, the position of each frame-member fitting piece 50*b* is shown, wherein both fitting pieces 50*b* are located at the end portions of the back wall of the frame member 50. As shown clearly in FIGS. 10 and 11A, 11B, each fitting claw 42 has a contact portion 42*a* formed so as to face to the back wall 23, and also has a slant face 42*b* forward thereof.

Figure 11B:
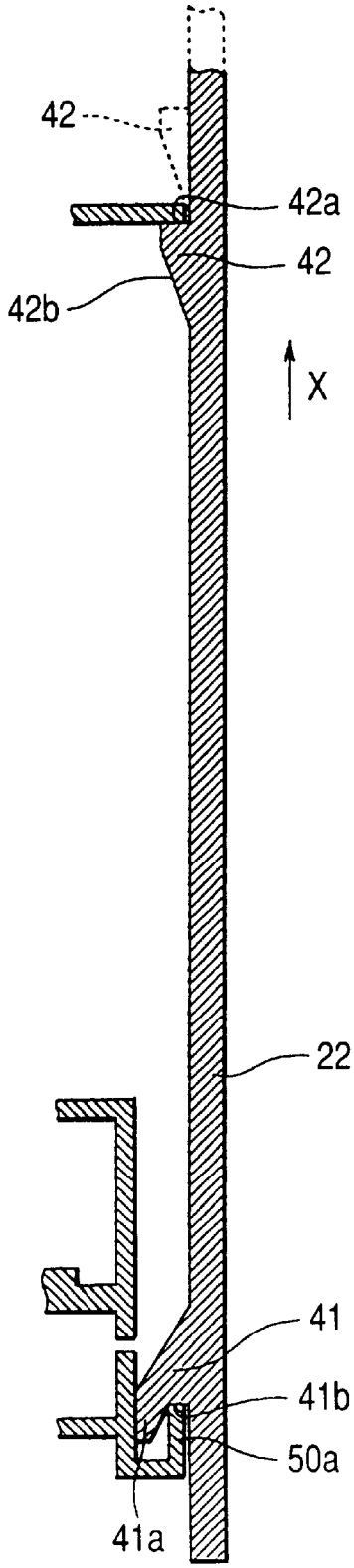
FIGS. 11A and 11B are enlarged views showing essential portions of FIG. 10.
Figure 11A:
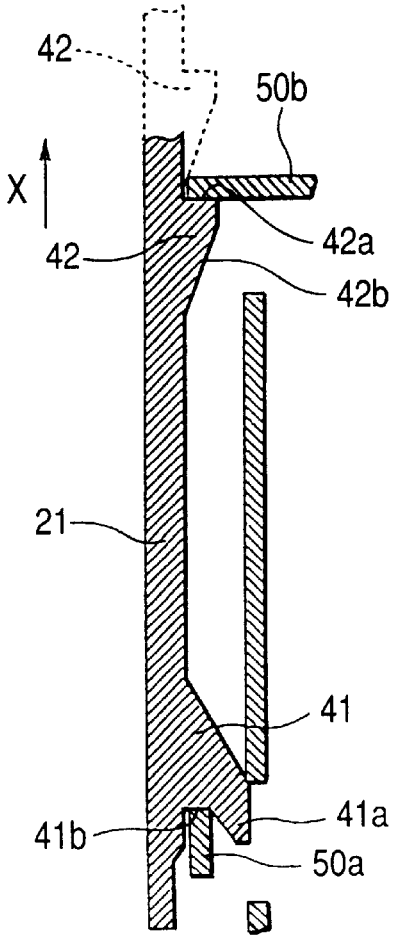

In a process of mounting the main case member 20 to the frame member 50—by sliding the main case member 20 from the backside of the frame member 50 toward the front of the frame member 50, as shown by a broken line in FIGS. 11A and 11B—the slant face 42*b* of the fitting claw 42 abuts against the fitting piece 50*b* of the frame member. As the main case member 20 is further slidingly advanced, the side walls 21, 22 of the main case member 20 are curved outward by the slant faces 42*b* so as to avoid the fitting pieces 50*b* until the fitting pieces 50*b* engage the contact faces 42*a*. In this state, the contact faces 42*a* fit to the inner faces of the fitting pieces 50*b*.

Figure 12:
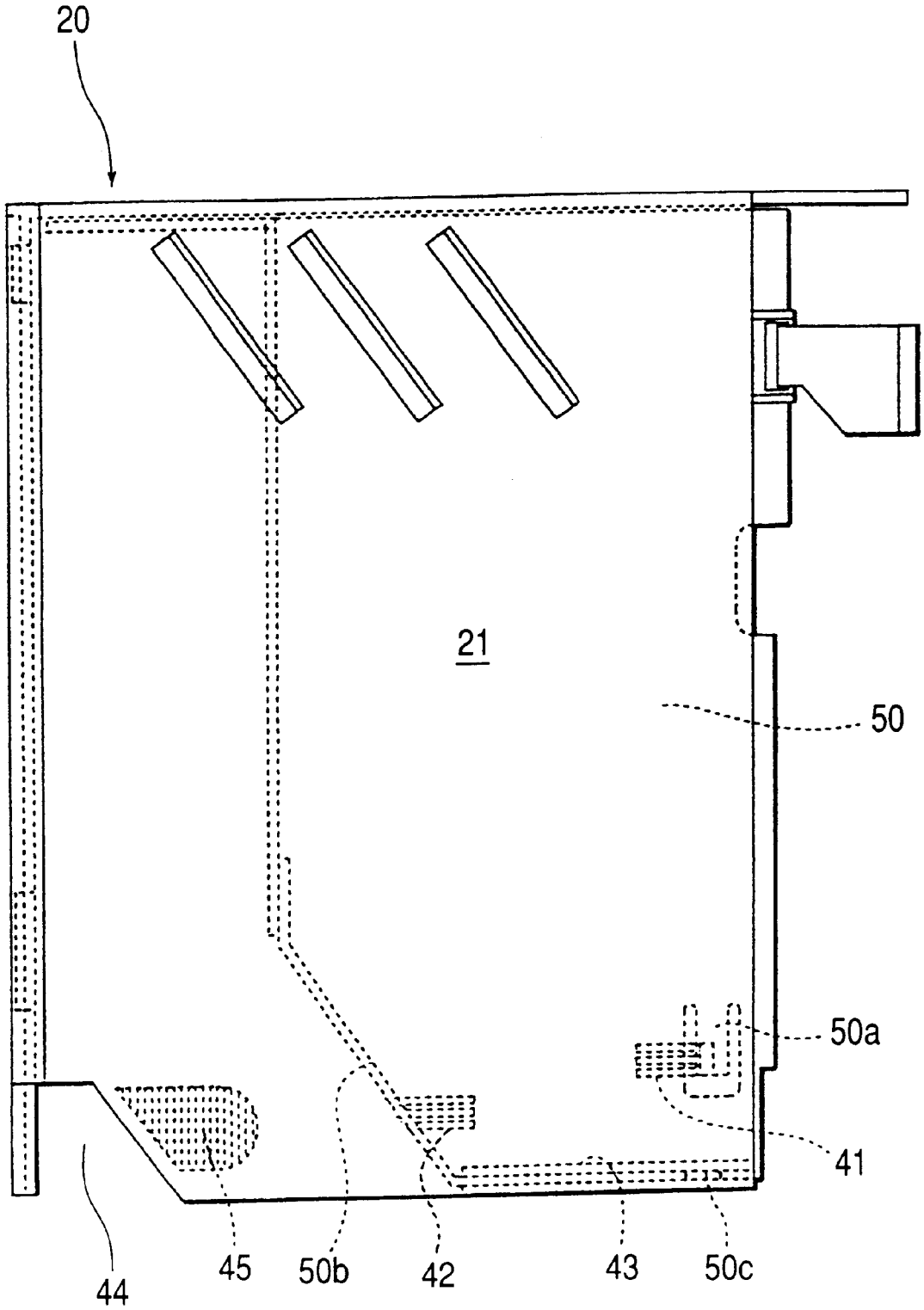
FIG. 12 is a side view showing the fitting relation between the main case member and the frame member.
Figure 13:
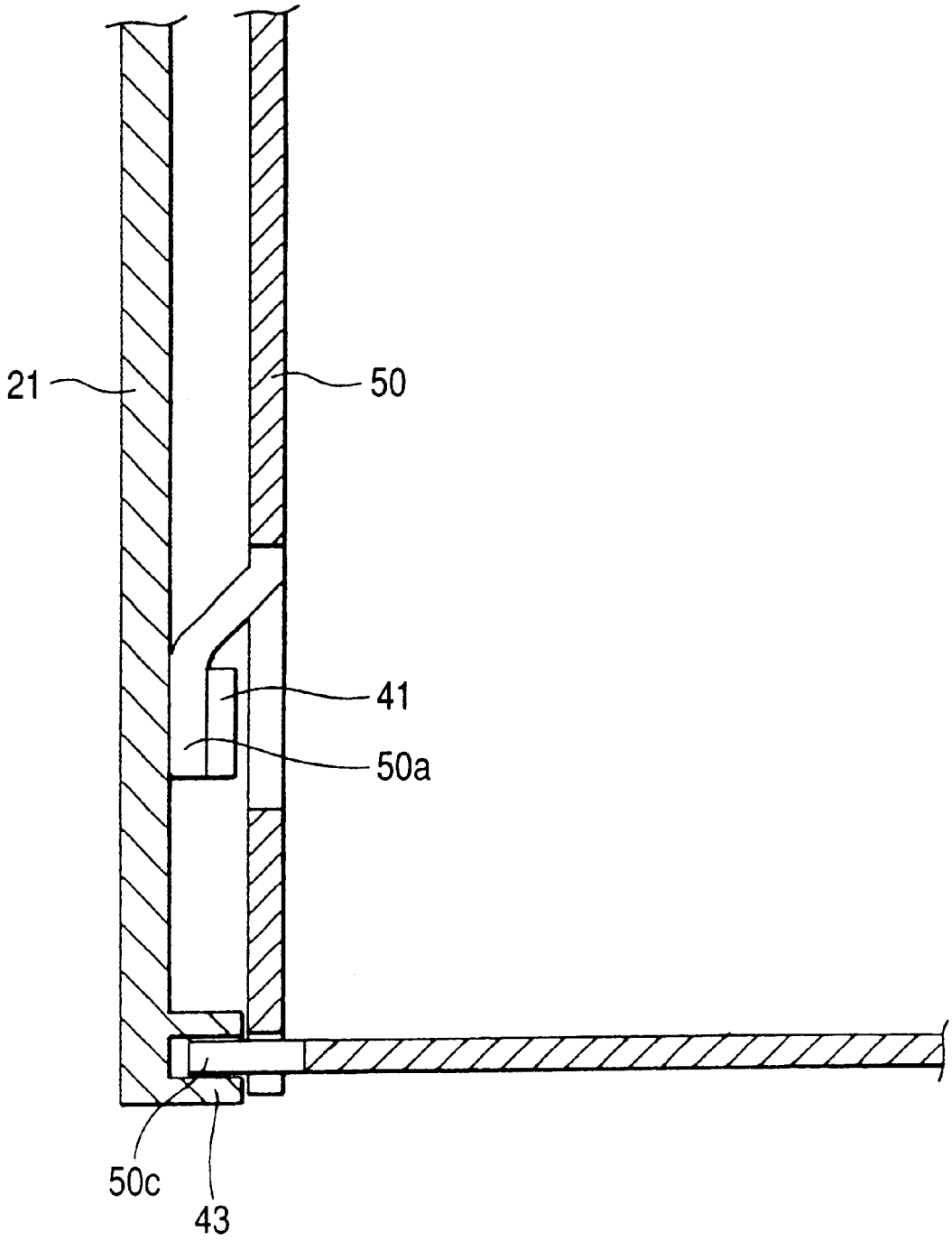
FIG. 13 is an enlarged sectional view showing an essential portion of FIG. 9B.

This above-described fitting restrains the main case member 20 from moving in the X direction in FIG. 3, and the main case member 20 is held in a state wherein it cannot be detached from the frame member 50. Here, the fitting claw 42 is located nearer the back wall 23 than is the fitting claw 41 as described before. When the main case member 20 is mounted to the frame is member 50, the front ends of the both side walls 21, 22—that is, the open ends thereof—cannot be opened outward due to the fitting between the fitting claw 41 and the fitting piece 50*a* of the frame member. Further, since the rear ends of both side walls 21, 22 are coupled by the back wall 23, the fitting between the fitting claws 42 and the fitting pieces 50*b* is not readily off. By each of the above constitutions, the main case member 20 is fixed at its lower portion to the frame member 50. Next, the structure for detaching the main case member 20 from the frame member 50 will be described. In FIGS. 8 and 12, cut-off portions 44 and press regions 45 are formed as component parts for releasing the engagement of the fitting claws 42 and the fitting pieces 50*b*. The cut-off portions 44 and press regions 45, which constitute a disengagement member, are formed nearer the back wall 23 are than the fitting claws 42 in the both side walls 21, 22 of the main case member 20. The cut-off portion 44 has such a size that a worker can insert a forefinger (or middle finger) into the main case member 20 from each one of the sides thereof. Further, each of the cut-off portions 44 extends from the rear portion of a side wall up to the back wall 23. The press regions 45 are regions touched with the tip of the worker's finger as that finger is inserted from the cut-off portion 44 when it is desired to detach the main case member 20 from the frame 50. Further, the press regions 45 are located in front of the cut-off portions 44. Nonskid treatment is applied to the press regions 45 by forming shallow grooves of narrow pitches.

As shown in FIG. 10, the worker inserts forefingers or middle fingers into the cut-off portions 44 from both sides of the main case member 20, and puts the tips of these fingers on the press regions 45. Next, by pulling both side walls 21, 22 with the tips of these fingers in the Y direction in that figure, the central regions of the side walls 21, 22 are curved outward, whereby the engagement between the fitting claw 42 and the fitting piece 50*b* is released. While this state is maintained, the main case member 20 is slid backward (X direction) in relation to the frame member 50 thereby detaching it from the frame member 50.

Figure 14:
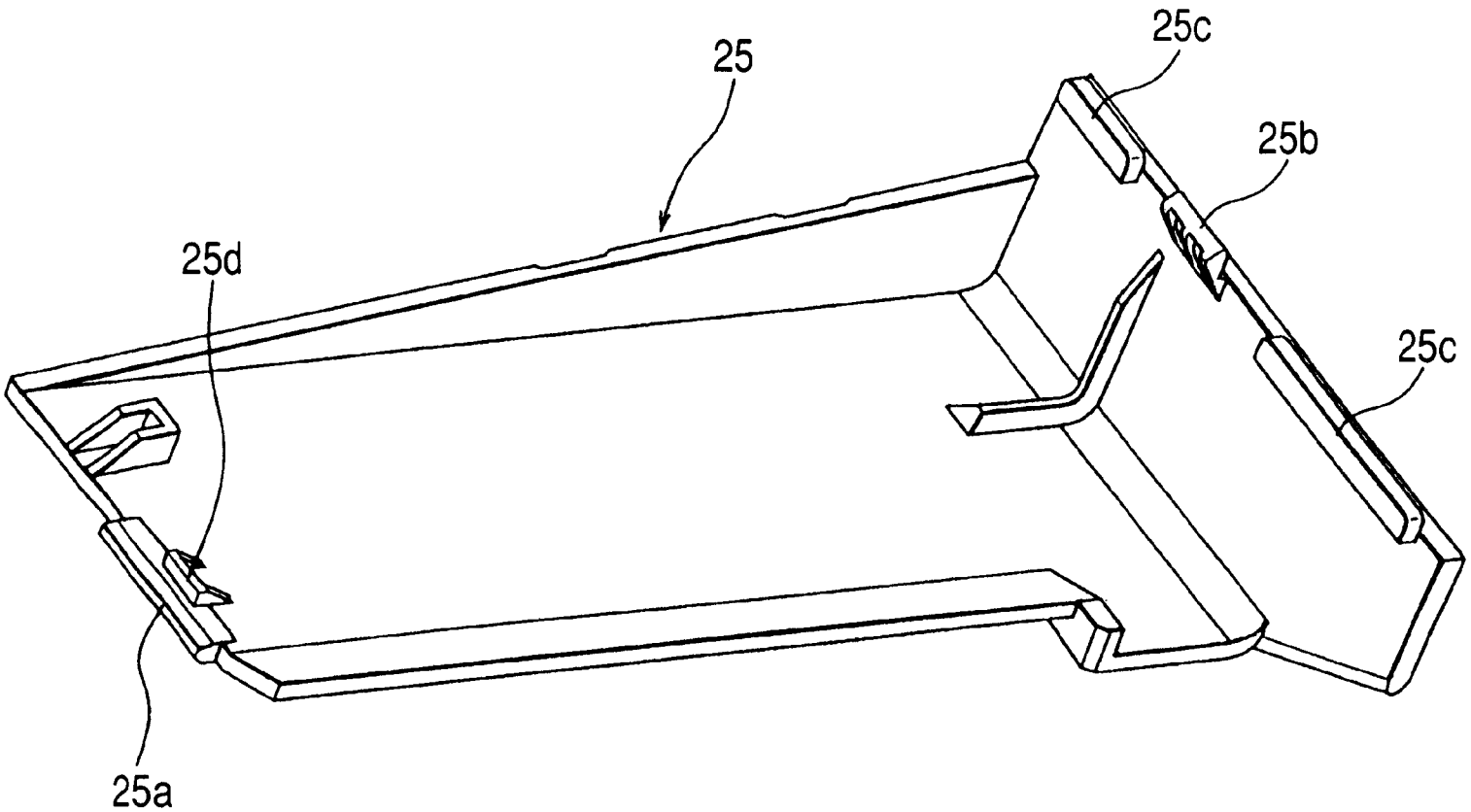
FIG. 14 is a perspective view of a fitting plate cover viewed from its backside.

Next, the fitting plate cover 25, which is placed outside the fitting plate 40, will be described. FIG. 14 is a perspective view of the fitting plate cover 25 as viewed from its backside. The fitting plate cover 25 is formed of the same material as that of each of the case members 20, 30, i.e., elastic material such as plastic or the like. As shown in FIGS. 2 and 14, the fitting plate cover 25 is formed substantially in the shape of an L, in a manner corresponding to the shape of the metal fitting plate 40 including its attaching region. At one end of the fitting plate cover 25 is formed a fitting piece 25*a*; and at the other end thereof is formed a fitting claw 25*b* and fitting pieces 25*c* located on both sides of the fitting claw 25*b*. Through these fitting pieces 25*a*, 25*c* and fitting claw 25*b*, the fitting plate cover 25 is fixed onto the printer casing.

The fitting plate cover 25 includes a protrusion 25*d* that protrudes from the back face of the fitting plate cover 25 so as to be brought into contact with the vicinity of the fitting hole 40*c* formed in the fitting plate 40.

Figure 15:
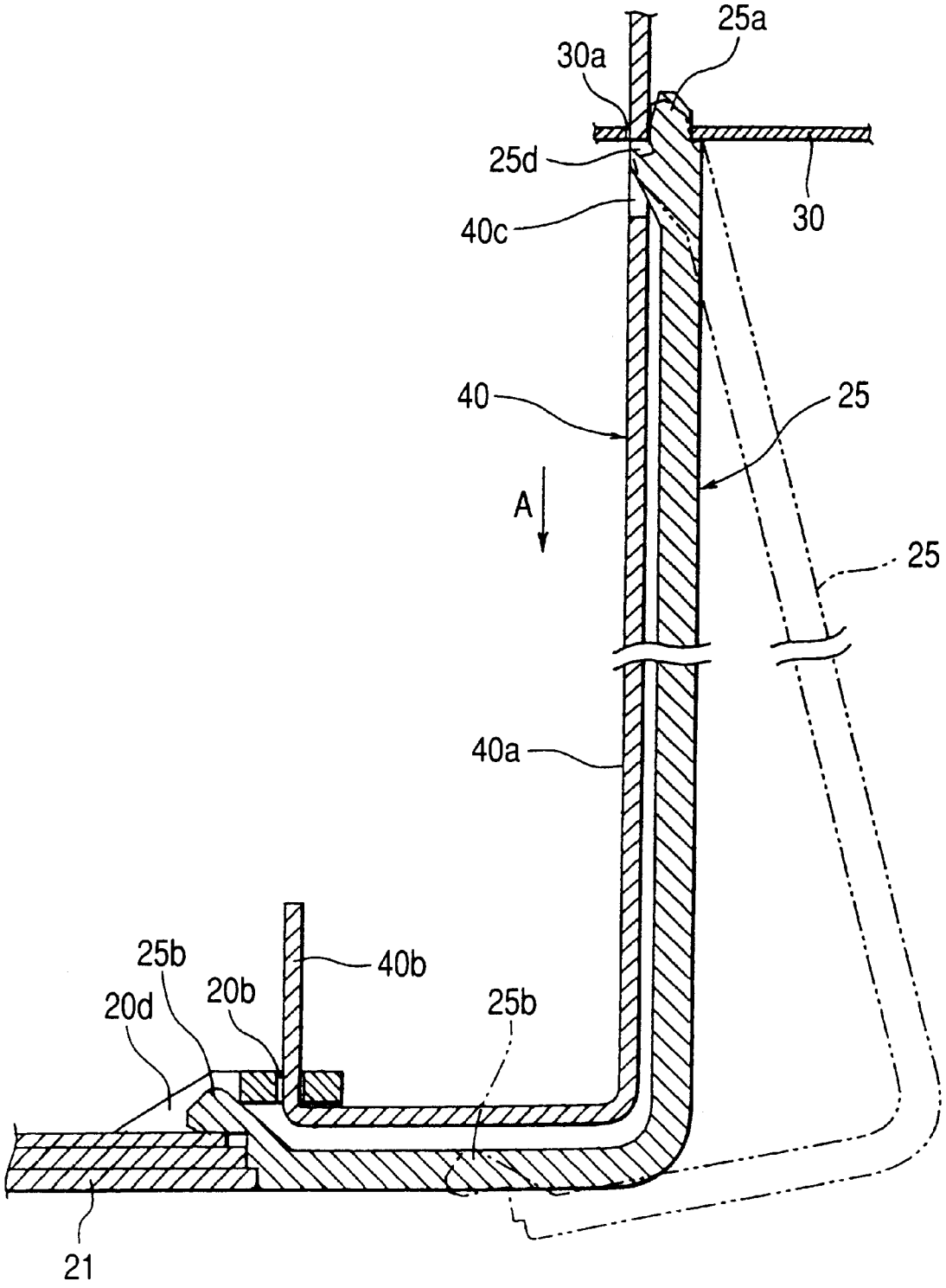
FIG. 15. is a sectional plan view in a state where a fitting plate cover is mounted to the printer casing.
Figure 16:
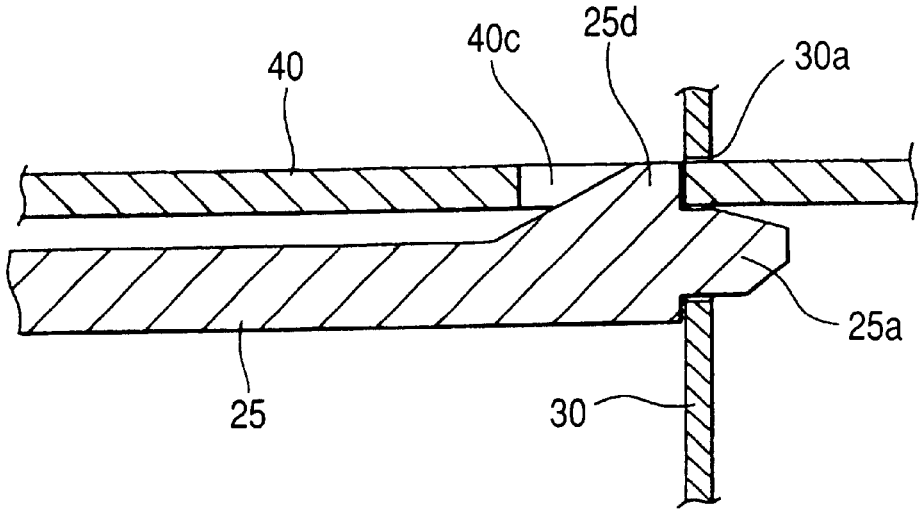
FIGS. 16 and 17 are enlarged views showing essential portions of FIG 15.
Figure 17:
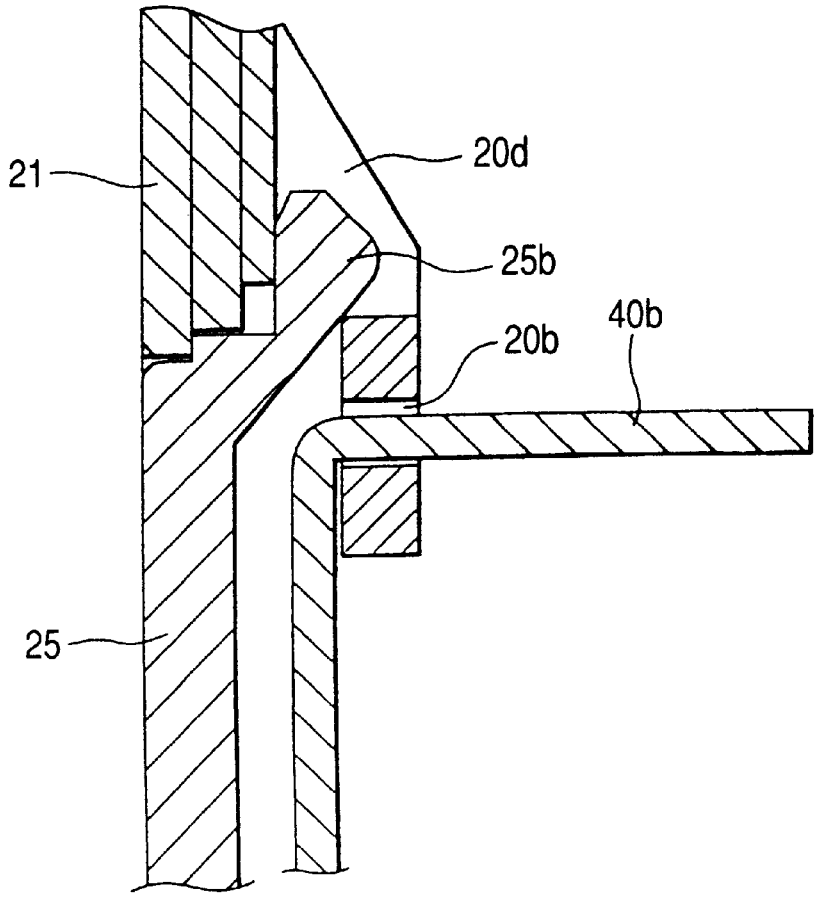

FIG. 15 is a sectional plan view showing how the fitting plate cover 25 is mounted to the printer casing, whereas FIGS. 16 and 17 are enlarged views of essential portions of FIG. 15. In these figures and FIG. 2, the fitting piece 25*a* is fitted to the fitting hole 30*a* through which the fitting plate 40 also passes, whereas the fitting claw 25*b* and fitting pieces 25*c* are fitted to a side edge of is the side wall 21 of the main case member 20. Through such arrangements, the fitting plate cover 25 is mounted to the casing side so that it covers the fitting plate 40. Further, the fitting claw 25*b* is fitted into a fitting hole 20*d* that is formed adjacent to the fitting hole 20*b* into which the second engagement portion 40*b* of the fitting plate 40 is inserted. See FIGS. 15 and 17. When the fitting plate cover 25 is attached to the casing side, the protrusion 25*d* fits into the fitting hole 40*c* of the fitting plate 40 so to prevent the fitting plate 40 from moving in the direction where the fitting plate slips (in the direction of an arrow A in FIG. 15).

To attach the fitting plate cover 25 to the casing side the fitting piece 25*a* is first inserted into the fitting hole 30*a* as shown by a phantom line in FIG. 15. At this time, the protrusion 25*d* (located in the vicinity of the fitting piece 25*a*) is brought into contact with the fitting hole 40*c* of the fitting plate 40, and then presses the fitting plate 40 in its inserting direction (in the direction opposite to the arrow A). Even if the fitting plate 40 is not inserted completely when the fitting plate cover 25 is mounted, the fitting plate 40 is pressed in its inserting direction by the protrusion 25*d* engaging the fitting hole 40*c*, so that the fitting plate 40 completely is inserted. Next, while the backside of the fitting plate cover 25 is slightly being curved, the fitting claw 25*b* and fitting pieces 25*c* are set inside the side edge of the side wall 21 of the main case member 20 and are fitted to the side edge. The fitting plate cover 25 is thus fixed to the casing of the printer so as to cover the fitting plate 40, At this time, the protrusion 25*d* fits into the fitting hole 40*c* in the fitting plate 40, and also prevents slip of the fitting plate 40.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, though the projection 20*c* is provided on the main case member 20 in the above embodiment, the projection may be provided on the frame member 50. In the above embodiment, the fitting claws 41, 42 and fitting groove 43 on the main case member 20, and the corresponding fitting pieces on the frame member 50 are used for fitting together the lower portions of the printer. However, a similar constitution may be used at the upper portions of the printer, or may be used for fixing of the front case member 30 to the frame member 50. Further, each fitting member of the invention can be adopted in a printer having a different casing structure.

Further, in the above embodiment, though the protrusion 25*d* formed on the fitting plate cover 25 fits into the fitting hole 40*c* of the fitting plate 40, a projection to which the protrusion 25*d* abuts may be formed on the fitting plate 40, or a hole to which the projection on the fitting plate 40 fits may be formed on the fitting plate cover 25. Further, when the invention is carried out, the protrusion 25*d* may be located in a position distant from the fitting piece 25*a*. For example, the protrusion 25*a* may be formed near the other fitting piece 25*c* and brought into contact with the bent-back region of the fitting plate 40.

What is claimed is:

1. A printer comprising:

a frame member for supporting components of the printer, the frame member including a first frame-side fitting member;

a first case member, which constitutes a part of an external shape-of the printer and which covers at least a part of the frame member, the first case member including:

a first side wall forming a side face of the printer;

a second side wall having a first end thereof connected to the first side wall, and having a second end opposite to the first end, wherein the second end is a free end;

a third side wall, opposite to the second side wall, having a first end connected to the first side wall, and having a second end opposite to the third-side-wall first end, wherein the third-side-wall second end is a free end;

a first case-side fitting member provided on the second side wall so as to be located on one side of the first frame-side fitting member when the first case member covers the frame member; and a second case-side fitting member provided on the third side wall so as to be located the other side of the first frame-side fitting member when the first case member covers the frame member; and an elongated fitting plate, for fixing the first case member with the frame member by engaging with the first frame-side fitting member as well as with the first and second case-side fitting members.

2. The printer as set forth in claim 1, further comprising a second case member, which constitutes another part of the external shape of the printer and which covers another part of the frame member, the second case member including:

a first side wall forming a side face of the printer, wherein said second-case-member first side wall opposes to the first, side wall of the first case member;

a second side wall having a first end connected to the second-case-member first side wall, and having a second end opposite to the second-case-member-second-side-wall first end, wherein the second-case-member-second-side-wall second end is a free end;

a third side wall, opposite to the second-case-member second side wall, having a first end connected to the second-case-member first side wall, and having a second end opposite to the second-case-member-third-side-wall first end, wherein the second-case-member-third-side-wall second end is a free end;

a third case-side fitting member provided on the second-case-member second side wall so as to be located on said one side of the first frame-side fitting member when the second case member covers the frame member; and a fourth case-side fitting member provided on the second-case-member third side wall so as to be located on said other side of the first frame-side fitting member when the second case member covers the frame member, wherein the elongated fitting plate fixes the first and second case members with the frame member by engaging the first frame-side fitting member as well as the first, second, third and fourth case-side fitting members.

3. The printer as set forth in claim 2, further comprising a cover member, which constitutes another part of the printer while engaging with at least one of the first and second case members and the frame member, the cover member including a protrusion for restricting movement of the elongated fitting plate by engagement therewith.

4. The printer as set forth in claim 3, wherein the cover member includes a first cover-side fitting member which is engaged with at least one of the second case member and the frame member, wherein the protrusion is formed in the vicinity of the first cover-side fitting member.

5. The printer as set forth in claim 4, wherein:

the cover member has a shape so as to extend along at least a part of the elongated fitting plate;

the first cover-side fitting member is formed on one end portion of the cover member; and the cover member further includes a second cover-side fitting member formed on the other end portion thereof, wherein said second cover-side fitting member is engaged with at least one of the first case member and the frame member.

6. The printer as set forth in claim 3, wherein the elongated fitting plate includes a hole, with which the protrusion is engaged when the cover member is engaged with at least one of the second case member and the frame member.

7. The printer as set forth in claim 1, wherein the frame member includes a second frame-side fitting member, with which the elongated fitting plate engages when the first case member is fixed with the frame member.

8. The printer as set forth in claim 7, wherein the elongated fitting plate includes:

a first portion extending in a first direction so as to include a first end of said elongated fitting plate;

a second portion extending in the first direction so as to include another end of said elongated fitting plate; and a third portion extending perpendicular to the first direction so as to connect the first and second portions;

wherein the first portion is engaged with the first frame-side fitting member as well as with the second, third and fourth case-side fitting members; and wherein the second portion is engaged with the second frame-side fitting member and the first case-side fitting member.

9. The printer as set forth in claim 1, wherein the first side wall of the first case member is urged so as to abut against an opposing face of the frame member when the elongated fitting plate engages with the first frame-side, first case-side, and second case-side fitting members.

10. The printer as set forth in claim 1, wherein the first frame-side fitting member is a through hole, through which the elongated fitting plate is inserted.

11. The printer as set forth in claim 10, wherein the through hole is provided with a guide portion for guiding the elongated fitting plate.

12. The printer as set forth in claim 1, wherein the frame member is attached to the first case member by moving the frame member from the second ends toward the first ends of the first-case-member second and third side walls, and the printer further comprising:

a first engagement member, for preventing the second ends of the second and third side walls of the first case member from separating, when the first case member covers the frame member;

a second engagement member, for preventing the first case member from being detached from the frame member in a reversed direction of the attaching direction, wherein the second engagement member is located closer to the first ends of the first-case-member second and third side walls than is the first engagement member; and a disengagement member, for releasing the engagement of the second engagement member, wherein the-disengagement member is located closer to the first ends of the first-case-member second and third side walls than is the second engagement member.

13. The printer as set forth in claim 12, wherein the first engagement member includes a first engagement claw formed on the first case member, and a first engagement piece formed on the frame member, and wherein the first engagement piece engages with the first engagement claw; and wherein the second engagement member includes a second engagement claw formed on the first case member, and a second engagement piece formed on the frame member, and wherein the second engagement piece engages with the second engagement claw.

14. The printer as set forth in claim 12, further comprising a third engagement member, for preventing the first case member from being detached from the frame member in a direction substantially orthogonal to the attaching direction, when the first case member covers the frame member.

15. The printer as set forth in claim 14, wherein the third engagement member includes a guide member for guiding the first case member in the attaching direction with respect to the frame member.

16. The printer as set forth in claim 12, wherein the disengagement member includes cut-off portions, respectively formed on the second and third side walls of the first case member, through which fingers may be inserted to press the second and third side walls outwardly.

17. The printer as set forth in claim 12, wherein the first case member includes a fourth side wall which extends substantially orthogonal to the first-case-member first side wall and which is connected to third ends of the first-case-member second and third side walls, wherein said first-case-member second and third side walls have fourth ends opposite to said first-case-member-second-and-third-side-wall third ends, and wherein the first and second engagement members are provided in a portion closer to the first-case-member-second-and-third-side-wall fourth ends than to the first-case-member-second-and-third-side-wall third ends.

18. The printer as set forth in claim 1, further comprising a cover member, which constitutes another part of the printer while engaging with at least one-of the first case member and the frame member, the cover member including a protrusion for restricting movement of the elongated fitting plate by engagement therewith.

* * * * *